US009456727B2

(12) United States Patent
Merz et al.

(10) Patent No.: US 9,456,727 B2
(45) Date of Patent: Oct. 4, 2016

(54) DRIVABLE FLOOR CLEANING MACHINE AND METHOD FOR OPERATING A FLOOR CLEANING MACHINE

(71) Applicant: Alfred Kärcher GmbH & Co. KG, Winnenden (DE)

(72) Inventors: Juergen Merz, Waiblingen (DE); Frank Nonnenmann, Schorndorf (DE)

(73) Assignee: Alfred Kärcher GmbH & Co. KG, Winnenden (DE)

( * ) Notice: Subject to any disclaimer, the term of this patent is extended or adjusted under 35 U.S.C. 154(b) by 339 days.

(21) Appl. No.: 14/168,444

(22) Filed: Jan. 30, 2014

(65) Prior Publication Data

US 2014/0144467 A1 May 29, 2014

Related U.S. Application Data

(63) Continuation of application No. PCT/EP2011/063305, filed on Aug. 2, 2011.

(51) Int. Cl.

| | |
|---|---|
| ***A47L 11/00*** | (2006.01) |
| ***A47L 11/40*** | (2006.01) |
| ***A47L 11/30*** | (2006.01) |

(52) U.S. Cl.

CPC ..... *A47L 11/4052* (2013.01); *A47L 11/302* (2013.01); *A47L 11/4055* (2013.01); *A47L 11/4058* (2013.01); *A47L 11/4061* (2013.01); *A47L 11/4069* (2013.01)

(58) Field of Classification Search

None

See application file for complete search history.

(56) References Cited

U.S. PATENT DOCUMENTS

| | | | |
|---|---|---|---|
| 3,938,212 | A | 2/1976 | Krier et al. |
| 5,659,918 | A | 8/1997 | Anthony et al. |
| 7,003,841 | B2 | 2/2006 | Mayer |
| 2002/0170130 | A1 | 11/2002 | Shinler |
| 2004/0025270 | A1 | 2/2004 | Mitchell et al. |

FOREIGN PATENT DOCUMENTS

| | | |
|---|---|---|
| EP | 2 080 468 | 7/2009 |
| JP | 2000-51128 | 2/2000 |

*Primary Examiner* — Eric Golightly

(74) *Attorney, Agent, or Firm* — Womble Carlyle Sandridge & Rice LLP

(57) ABSTRACT

A drivable floor cleaning machine is provided, including a chassis, at least one cleaning head, and a holding device capable of holding the cleaning head on the chassis and lifting it relative to the chassis, the holding device including a first rod device rotatably held by a first bearing device on the chassis, a second rod device rotatably held on the chassis by means of a second bearing device, a third bearing device rotatably holding the cleaning head on the first rod device, and including a fourth bearing device rotatably holding the cleaning head on the second rod device, wherein the cleaning head is supported on a stop when a specific lifting position of the cleaning head relative to the chassis is reached, and on which stop the cleaning head can be rotated.

27 Claims, 9 Drawing Sheets

DRIVABLE FLOOR CLEANING MACHINE AND METHOD FOR OPERATING A FLOOR CLEANING MACHINE

CROSS-REFERENCE TO RELATED APPLICATIONS

This application is a continuation of international application number PCT/EP2011/063305, filed on Aug. 2, 2011, which is incorporated herein by reference in its entirety and for all purposes.

BACKGROUND OF THE INVENTION

The invention relates to a drivable floor cleaning machine, comprising a chassis, at least one cleaning head and a holding device by means of which the at least one cleaning head is held on the chassis and is liftable relative to the chassis, the holding device comprising a first rod device, which is rotatably held by a first bearing device on the chassis, comprising a second rod device, which is rotatably held on the chassis by means of a second bearing device, comprising a third bearing device, by means of which the at least one cleaning head is rotatably held on the first rod device, and comprising a fourth bearing device, by means of which the at least one cleaning head is rotatably held on the second rod device.

The invention furthermore relates to a method for operating a floor cleaning machine, which has a cleaning head that is liftable with respect to a chassis.

Drivable floor cleaning machines are used in order to effectively be able to clean large areas in a time-saving manner.

SUMMARY OF THE INVENTION

In accordance with the present invention, a drivable floor cleaning machine is provided, which has improved handling possibilities.

In accordance with an embodiment of the invention, a stop is associated with the at least one cleaning head, on which stop the at least one cleaning head is supported when a specific lifting position of the at least one cleaning head relative to the chassis is reached and on which the at least one cleaning head is rotatable by means of the support relative to the chassis.

Owing to the lifting possibility, floor irregularities, for example, can be compensated or it is possible to compensate wear on the cleaning head (such as, for example, brush wear), in that, a defined lifting position is set by the operator depending on the wear.

An inclination of the cleaning head can be achieved in the solution according to the invention by using the holding device and by means of the stop. Travelling on a ramp is facilitated thereby as the spacing between the cleaning head at a front end of the cleaning head and a base can be increased. This, in particular, enables easier loading of the drivable floor cleaning machine.

These extended handling possibilities are achieved in a structurally simple manner.

In particular, a relative angular orientation at the lower side of the at least one cleaning head with respect to the chassis remains the same until the specific lifting position of the at least one cleaning head is reached independently of the rotational position of the first rod device. If, for example, the cleaning machine is standing on a level base, the lower side remains parallel to this base until the specific lifting position is reached, independently of the rotational position of the first rod device.

It is favorable if the second rod device and/or the second bearing device are flexible such that an inclination movement of the cleaning head is made possible with support on the stop. As a result, constraints, which would otherwise prevent an inclination movement, are eliminated.

In an advantageous embodiment, the second bearing device comprises a rotary-slide bearing or is configured as a rotary-slide bearing. This allows a displacement of the second rod device as a whole to be easily achieved relative to the chassis in order to achieve an inclination movement of the cleaning head by support on the stop.

Basically it is also possible, for example, for the second rod device to be flexible and, for example, telescopic, in order to eliminate constraints, which would otherwise prevent an inclination movement.

A counter-face is advantageously associated with the stop, said counter-face being arranged or formed on a housing of the at least one cleaning head. As a result, the cleaning head can be supported on the stop in order to form a rotary bearing or pivot bearing for the inclination.

In particular, a stop face of the stop is arranged between the first rod device, the second rod device and the at least one cleaning head, and, in particular, also arranged in a fixed manner with respect to the chassis. Thus, as long as the specific lifting position has not yet been reached, a parallel orientation of the cleaning head can be reached independently of the lifting position. When a support is reached, the inclination movement can be realized.

For the same reason, it is favorable if the stop face, in relation to the first bearing device, second bearing device, third bearing device and fourth bearing device, is arranged closest to the third bearing device. This allows an inclination movement to be realized in a structurally simple manner.

It is quite particularly advantageous if, upon rotation of the at least one cleaning head, by means of support on the stop, a lower side of the at least one cleaning head is at an acute angle to a base when the floor cleaning machine is placed on a level base, and wherein a front end of the at least one cleaning head, in relation to a forward travel direction of the floor cleaning machine, has a greater spacing from the base than a rear end of the at least one cleaning head. As a result, to a certain extent, a "rim width" at a front end of the floor cleaning machine can be increased in relation to the base in order, for example, to make it easier to travel onto a ramp or to make it possible at all.

In particular, the third bearing device is arranged at or close to a front end, in relation to a forward travel direction of the floor cleaning machine, of the first rod device. This allows the at least one cleaning head to be rotatably mounted on the first rod device in a simple manner.

It is furthermore favorable if the first bearing device is arranged between the front end and a rear end of the first rod device. For example, this allows a lever arm to easily be formed to actuate a rotary movement of the first rod device.

In particular, the first rod device then comprises a lever arm, which is arranged between a rear end and the first bearing device. A rotary movement of the first rod device and therefore a lifting movement of the cleaning head and, after reaching the specific lifting position, also an inclination movement of the cleaning head can be brought about by means of a lever arm at a location remote from the first bearing device.

In particular, the lever arm forms an actuating device for a rotary movement of the first rod device at the first bearing device or has an operative connection with an actuating device. For example the lever arm is connected to a pedal. By means of pedal pressure, a rotary movement of the first rod device can then be brought about. As a result, the corresponding mechanism to lift the at least one cleaning head and to incline the at least one cleaning head relative to the chassis can be realized in a structurally simple manner.

Advantageously, the fourth bearing device is arranged at or close to a front end, in relation to a forward travel direction of the floor cleaning machine, of the second rod device. As a result, the space requirement for the second rod device can be minimized.

For the same reason, it is favorable if the second bearing device is arranged at or close to a rear end of the second rod device.

In particular, a spacing of rotational axes of the first bearing device and the third bearing device is fixed. As a result, a lifting movement can easily be realized and a lifting position of the cleaning head fixed.

It is advantageous if a spacing of rotational axes of the first bearing device and the second bearing device is variable, this spacing in particular remaining fixed when the at least one cleaning head is not supported on the stop. This allows it to be easily achieved that as long as the specific lifting position has not been reached, the cleaning head can be lifted in parallel, and after reaching the specific lifting position, an inclination of the at least one cleaning head relative to the chassis takes place.

In particular, the position of a rotational axis of the first bearing device relative to the chassis is fixed. The at least one cleaning head can thus be positioned by means of the first rod device.

A spacing between rotational axes of the second bearing device and fourth bearing device is fixed and, in particular, a position of the rotational axis of the second bearing device relative to the chassis is displaceable. As a result, a parallel lifting can be achieved in a structurally simple manner until the specific lifting position is reached and once said specific lifting position has been reached, an inclination movement can be brought about.

In one embodiment, a maximum displacement value of the second rod device is in a range between 15 mm and 40 mm. The displacement path is located, in particular, on the second bearing device.

For example, the specific lifting position is provided when the at least one cleaning head is lifted at a spacing in the range between 15 mm and 35 mm over a base when the floor cleaning machine is standing on a level base.

It is advantageous if connecting lines between the rotational axes of the first bearing device and the third bearing device, the third bearing device and the fourth bearing device, the fourth bearing device and the second bearing device and the second bearing device and the first bearing device form a parallelogram when the at least one cleaning head is not supported on the stop. This allows a parallel lifting (and lowering) of the at least one cleaning head to be easily achieved by means of the corresponding parallelogram structure. To a certain extent, there is an engagement in the parallelogram structure by the stop in order to allow an inclination.

It is favorable if a fixing device is provided by means of which one or more rotational positions of the first rod device can be fixed. As a result, an operator obtains optimized adaptation possibilities.

The second rod device can be arranged in the region of a wheel of the floor cleaning machine in a space-saving manner. As a result, an effective parallelogram structure can also be realized to lift the at least one cleaning head.

In particular, the fourth bearing device, in relation to a forward travel direction of the floor cleaning machine, is arranged in a region in front of the wheel and the second bearing device is arranged in a region behind the wheel and, in particular, the wheel is positioned between the second bearing device and the fourth bearing device. This results in an optimized use of space. The second rod device can, in particular, be configured as a type of rocker member that "bridges" the wheel laterally.

The drivable floor cleaning machine according to the invention is, in particular, configured as a self-propelled floor cleaning machine, a drive motor device being able to be provided for the travelling movement.

For example, the drivable floor cleaning machine according to the invention is configured as a walk-behind machine, in which an operator moves behind the floor cleaning machine and to a certain extent trails it.

The at least one cleaning head is, in particular, driven in order to carry out a preferably rotating or oscillating cleaning movement. It is, for example, a brush head or scrubbing head.

In accordance with the present invention, a method is provided for operating a floor cleaning machine in an effective manner.

In accordance with an embodiment of the invention, the cleaning head is supported on a stop by being lifted into a specific position in relation to the chassis and an inclination of the cleaning head is brought about by the support, by means of which inclination the spacing of a front end of the cleaning head, in relation to a forward travel direction, from a base, on which the floor cleaning machine is standing, is increased.

The method according to the invention has the advantages already described in conjunction with the floor cleaning machine according to the invention.

Further advantageous configurations of the method according to the invention have already been described in conjunction with the floor cleaning machine according to the invention.

In particular, the method according to the invention can be carried out using the floor cleaning machine according to the invention.

In particular, the cleaning head is lifted by a rotary movement of a rod device, on which the cleaning head is rotatably mounted.

The following description of preferred embodiments is used to describe the invention in more detail in conjunction with the drawings.

DETAILED DESCRIPTION OF THE INVENTION

Figure 1:
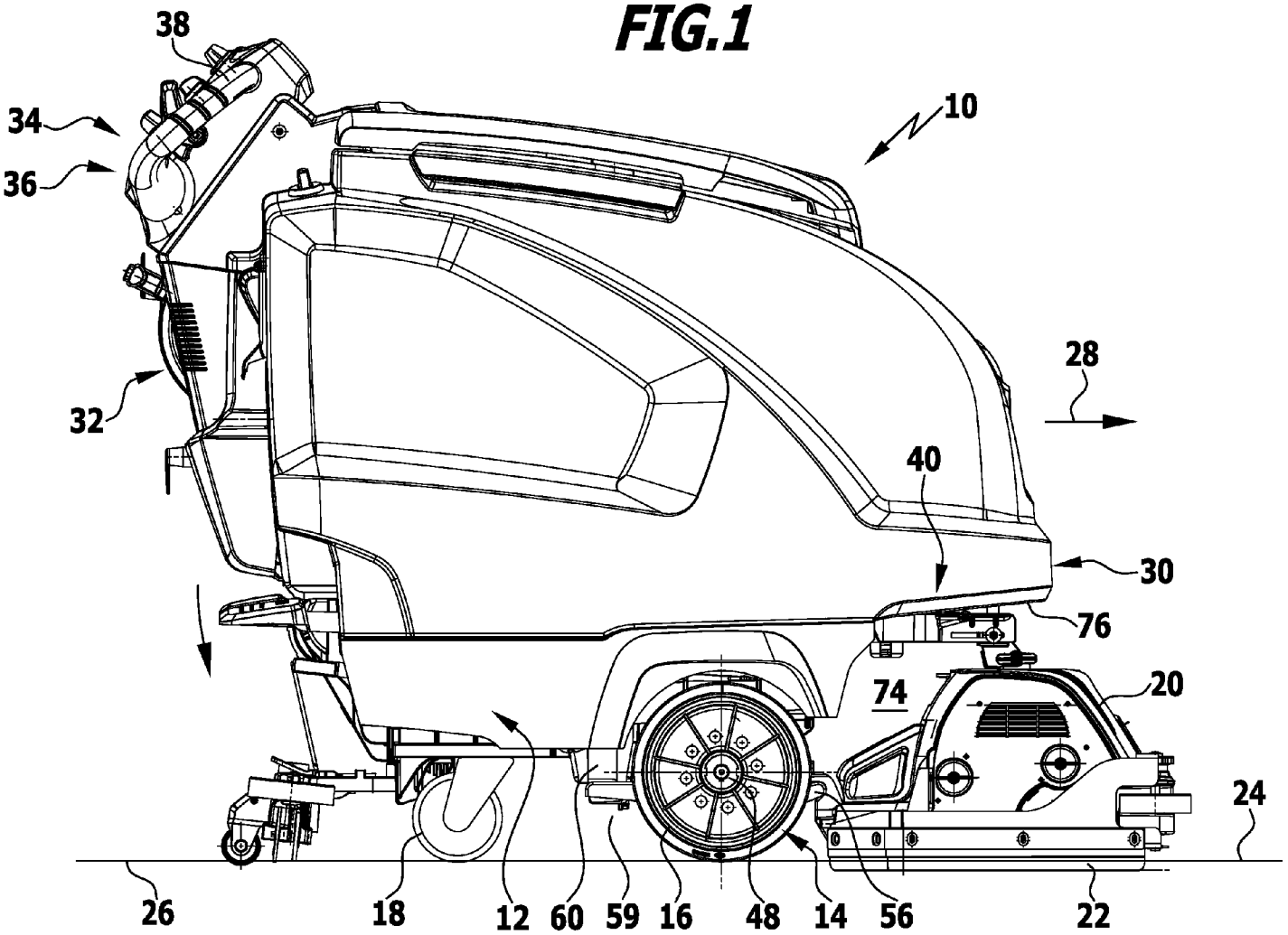
FIG. 1 shows a side view of an embodiment of a floor cleaning machine according to the invention.

An embodiment of a floor cleaning machine 10 according to the invention, which is shown in FIGS. 1 to 8, is a sweeping machine such as, for example, a walk-behind sweeping machine. This comprises a chassis 12. Arranged on the chassis 12 is a wheel device 14 with a right-hand wheel 16, a left-hand wheel 17 (cf. FIG. 2) and one or more support wheels 18. The right-hand wheel 16 and the left-hand wheel 17 are driven by means of a drive motor device (not shown in the drawings). One or more sweepings containers, for example, are provided (not shown in the drawings).

Seated on the chassis 12 is (at least) one cleaning head 20. This cleaning head 20 is, for example, a brush head with a brush device 22. The cleaning head 20 can act on a surface 24 to be cleaned. The floor cleaning machine 10 is placed here by means of the wheel device 14 on a floor 26, on which the surface to be cleaned is in turn located.

The cleaning head 20 is driven for a cleaning movement and, in particular rotary movement of the brush device 22 and, in particular, driven by a motor.

The cleaning head 20 can, for example, also be configured as a scrubbing head.

The floor cleaning machine 10 can also comprise a suction device for sucking up dirt (not shown in the drawings).

The floor cleaning machine 10, in relation to a forward travel direction 28, has a front end 30 and a rear end 32. A guiding device 34 and an operating device 36 for the user are arranged at the rear end 32. The guiding device 34 comprises a handle unit 38.

The cleaning head 20 is arranged in the region of the front end 30 of the floor cleaning machine 10. It is held on the chassis 12 by means of a holding device designated 40 as a whole.

Figure 2:
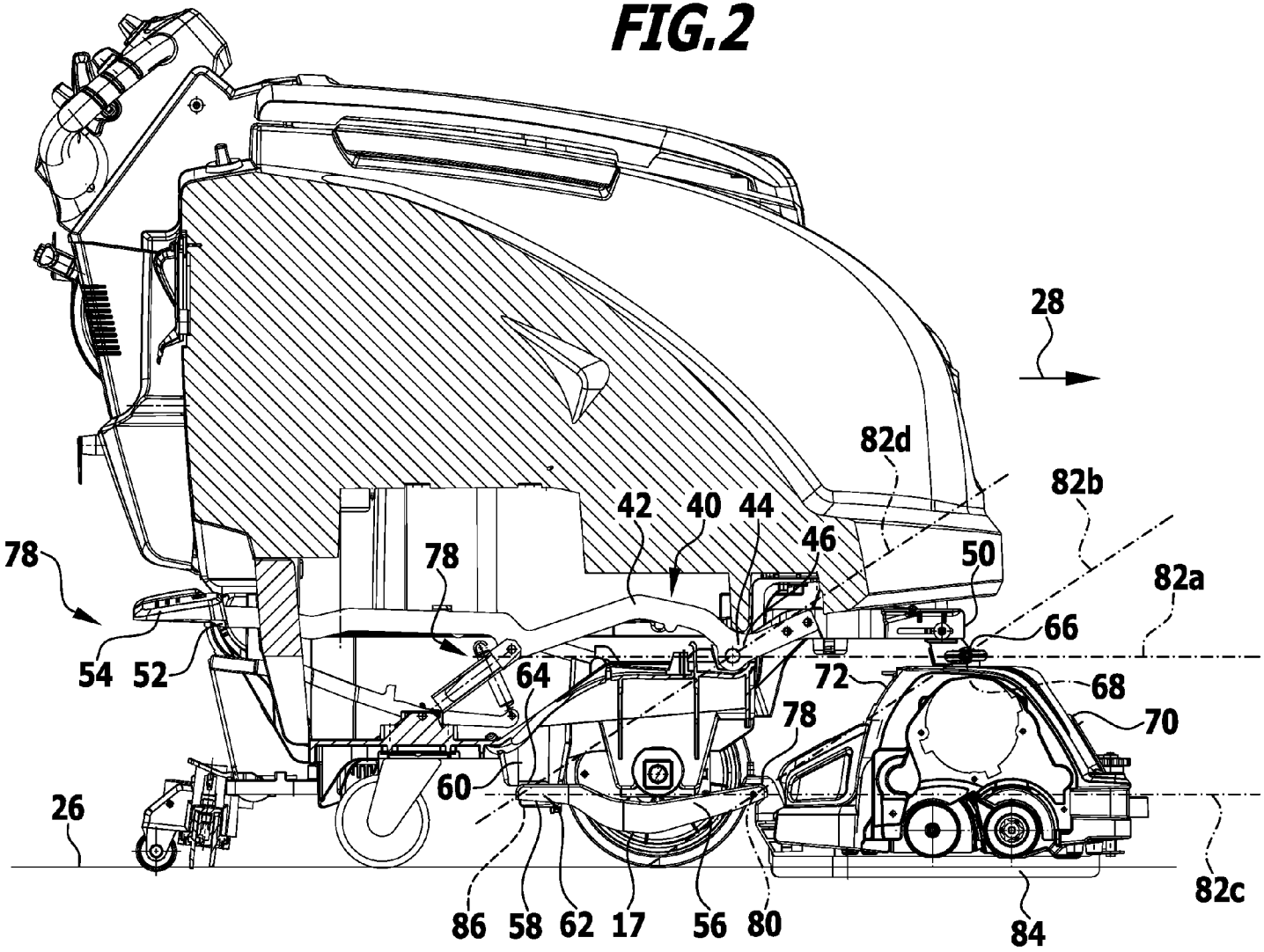
FIG. 2 shows a partial sectional view of the floor cleaning machine according to FIG. 1.

The holding device 40 comprises a first rod device 42 (FIG. 2). The first rod device is rotatably held on the chassis 12 on a first bearing device 44. The first bearing device 44 is formed by means of a pure rotary bearing. A rotational axis 46 (pivot axis) is, in particular, parallel to a wheel axis 48 of the right-hand wheel 16 and the associated left-hand wheel 17. In FIG. 2, the rotational axis 46 is perpendicular to the plane of the drawing.

The first rod device 42 is rotatable or pivotable as a whole on the first bearing device 44 about the rotational axis 46.

The first rod device 42 has a front end 50 and a rear end 52. It extends from the rear end 32 of the floor cleaning machine 10 to the front end 30 thereof. The first bearing device 44 with the rotational axis 46 is arranged between the front end 50 and the rear end 52.

A pedal 54 is connected in a fixed manner to the first rod device 42 in the region of the rear end 52 as an actuating device. By actuating the pedal, an operator can pivot the first rod device about the rotational axis 46. This pivoting takes place by a direct action of force by the operator on a lever arm of the first rod device 42, which lever arm is formed between the rear end 52 and the first bearing device 44.

It is basically also possible for a rotary movement or pivoting movement to be able to be effected by means of an actuating device on the first rod device 42, this actuating device, for example, comprising a drive such as a motor drive or fluid drive. A user can transmit corresponding control signals to this drive by means of the operating device 36.

In one embodiment, the first bearing device 44, in relation to the direction of gravity, is arranged above the associated wheel (for example the right-hand wheel 16) (in relation to the case where the floor cleaning machine 10 is standing on a level floor 26). The rotational axis 46 is located in a fixed manner in relation to the chassis 12.

The holding device 40 furthermore comprises a second rod device 56. This second rod device 56 is rotatably held by means of a second bearing device 58 on the chassis 12. A holding element 60, which holds the second bearing device 58, is arranged in a region 59 behind the right-hand wheel 16 so as to be connected to the chassis 12 in a fixed manner. The second bearing device 58 comprises a rotary-slide bearing 62 here, which holds the second rod device 56 rotatably about a rotational axis 64 and displaceably transversely and, in particular, perpendicularly, with respect to this rotational axis 64. In connection therewith, the rotational axis 64 is parallel to the rotational axis 46. The rotational axis 64 is displaceable by means of the rotary-slide bearing 62 relative to the chassis 12. As a result, the second rod device 56 is also rotatable (pivotable) by means of the second bearing device 58 about the rotational axis 64 relative to the chassis 12 and displaceable relative to the chassis 12.

The cleaning head 20 is rotatably (pivotably) held by means of a third bearing device 66 on the first rod device 42 in the region of a front end 30 of the second rod device 42. The third bearing device 66 defines a rotational axis 68 (pivot axis); this is parallel to the rotational axis 46. The third bearing device 66 is held here by a first element on the first rod device 42 in a fixed manner. The third bearing device 66 has a second element that is rotatable or pivotable with respect to the first element and is held in a fixed manner on a housing 70 of the cleaning head 20. The second element is, in particular, held on an upper region 72 of the housing 70 of the cleaning head 20.

A free region 74, in which the cleaning head 20 is arranged, is provided between the wheels 16, 17 and the front end 30 of the floor cleaning machine. The free region 74 is upwardly limited by an "overhang region 76". The upper region 72 of the housing 70 is oriented towards the overhang region 76.

The third bearing device 66 is configured as a pure rotary bearing.

The cleaning head 20 is held on the second rod device 56 so as to be rotatable about a rotational axis (pivot axis) 80 by means of a fourth bearing device 78, and specifically held in a region of a front end of the second rod device 56. The rotational axis 80 is parallel to the rotational axis 46 here. The fourth bearing device 78 is positioned in a region in front of (in relation to the straight ahead travel direction 30) the corresponding wheel (such as the right-hand wheel 16). The fourth bearing device 78 is configured as a pure rotary bearing.

The second rod device 56 extends in the manner of a rocker member from the rear region 59 behind the right-hand wheel 16 to the front region in front of the right-hand wheel 16.

In one embodiment, the second rod device is arranged between the right-hand wheel 16 and the left-hand wheel 17 and the chassis 12 (cf. FIGS. 1 and 2).

The articulation of the second rod device 56 by means of the fourth bearing device 78 on the cleaning head 20 takes place on the housing 70 in a region, which, in relation to the direction of gravity, is below the articulation of the cleaning head 20 on the third bearing device 66 (in relation to the case where the floor cleaning machine 10 with the wheel device 14 is standing on a level base).

Furthermore, the articulation point of the fourth bearing device 78 on the cleaning head 20 in a direction parallel to the forward travel direction 28 is offset with respect to the articulation of the cleaning head 20 on the third bearing device 66. The articulation point on the fourth bearing device 78 is located closer to the wheel (for example the right-hand wheel 16) than the articulation point on the third bearing device 66.

The rotational axis 46 of the first bearing device 44 is fixed with respect to the chassis 12. The rotational axis 68 of the third bearing device 66 is fixed in relation to the first rod device 42. A spacing between the rotational axis 46 and the rotational axis 64 is fixed.

The rotational axis 80 of the fourth bearing device 78 is fixed with respect to the cleaning head 20. The rotational axis 68 of the third bearing device 66 is also fixed with respect to the cleaning head 20. The spacing between the rotational axes 68 and 80 is fixed.

The rotational axis 64 of the second bearing device 58 is fixed with respect to the second rod device 56. The spacing between the rotational axis 64 and the rotational axis 80 of the fourth bearing device 78 is fixed.

Figure 4:
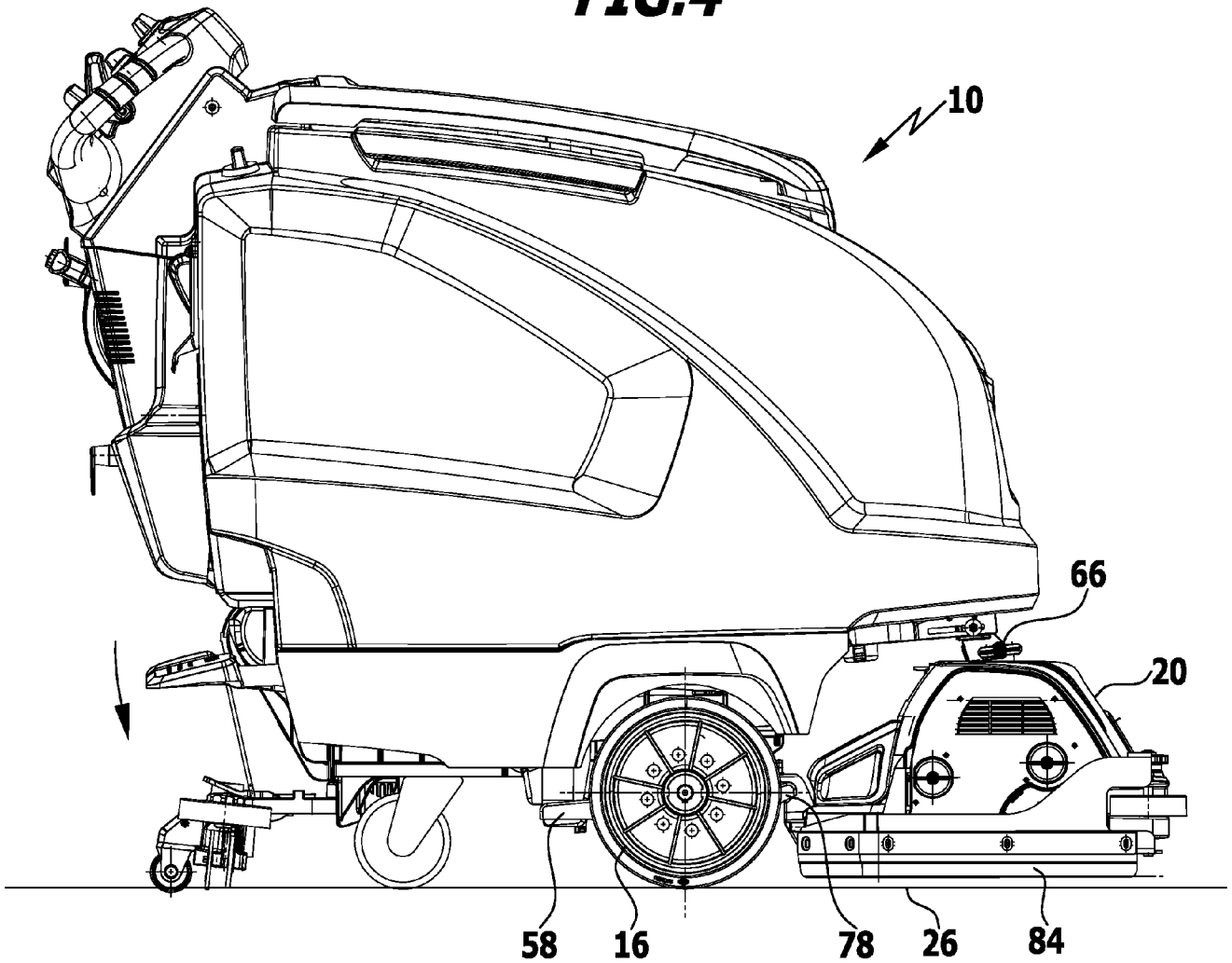
FIG. 4 shows the same view as FIG. 1 in a lifting position (intermediate position) of the cleaning head.
Figure 5:
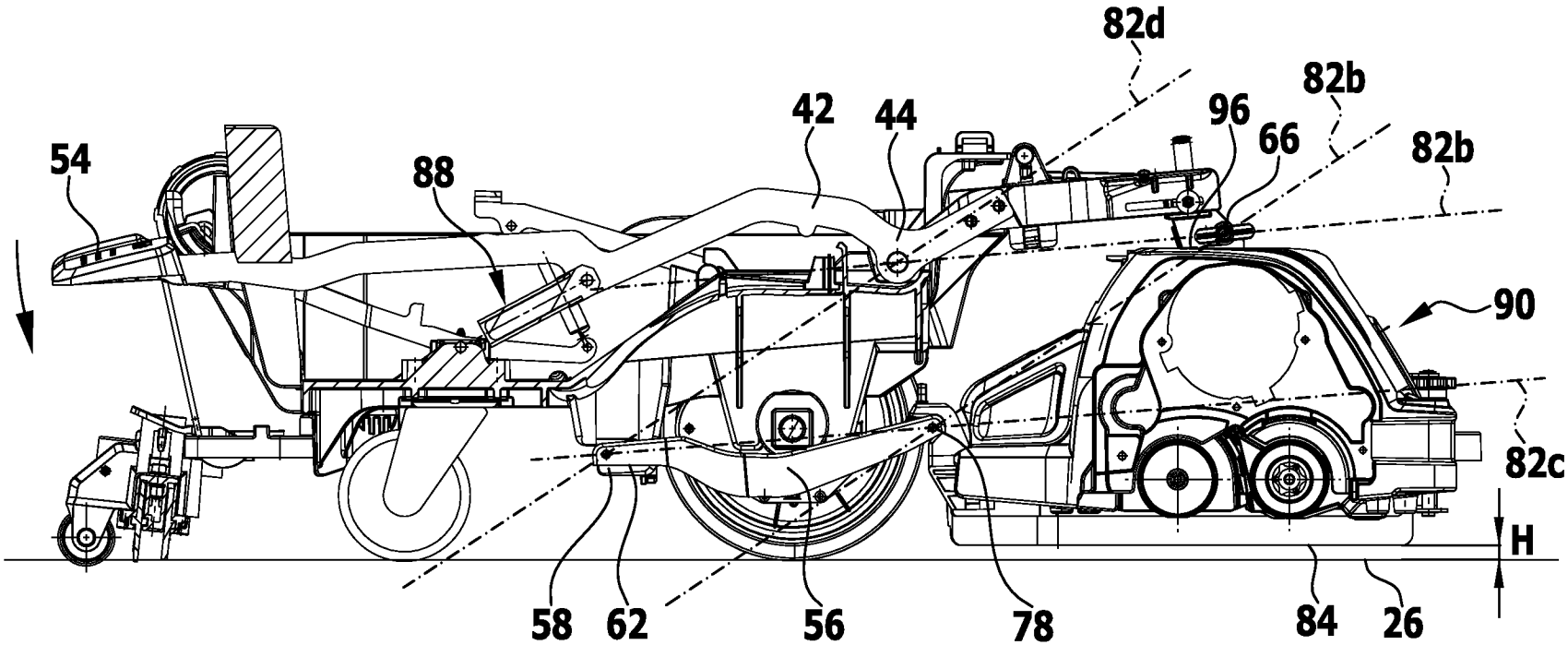
FIG. 5 shows a detailed view of the cleaning head with a lifting mechanism according to FIG. 4.

The cleaning head can be lifted by the holding device 40, as shown in FIGS. 4 and 5. Up to a specific lifting position, which will be described in more detail below, connecting lines 82*a* between the rotational axis 46 of the first bearing device 44 and the rotational axis 68 of the third bearing device 66, 82*b*, between the rotational axis 68 and the rotational axis 80 of the fourth bearing device 78, 82*c*, between the rotational axis 80 and the rotational axis 64 of the second bearing device 58 and 82*d*, between the rotational axis 80 and the rotational axis 46 form a parallelogram.

When the floor cleaning machine 10 is standing on the level floor 26, a lower side 84 of the cleaning head 20 can be positioned and lifted parallel to the floor 26. The configuration of the holding device 40 ensures the corresponding parallel orientation. Up to the specific lifting point, the second bearing device 58 acts as a pure rotary bearing, in other words the position of the rotational axis 64 relative to the chassis 12 is not displaced. Up to this specific lifting position, the second rod device 56 is located on the second bearing device 58 in a marked position 86, which is, for example, a stop position.

By means of the lifting of the cleaning head 20, which takes place controlled by a user, in particular by means of the pedal 54, irregularities can be traveled over, for example, or wear to the cleaning head 20 (for example on the brush device 22) can also be compensated by a new lifting position of the cleaning head 20, wherein a parallel orientation of the lower side 84 with respect to the floor 26 is retained.

In particular, a fixing device 88 is provided, by means of which an operator can fix a specific pivoting position of the first rod device 42 and therefore a specific lifting position of the cleaning head 20. The fixing may be stepless here or steps for specific lifting positions may be provided.

FIG. 5 shows a lifting position 90 of the cleaning head 20, in which the lower side 84 is oriented parallel to the floor 26. The lower side 84 is at a height H above the floor 26 here.

A stop 92 (cf. in particular FIGS. 3 and 8), which provides a stop face 94, is associated with the cleaning head 20. The stop 92 is, in particular, connected to the first rod device 42 in a fixed manner and formed, for example, on the first element of the third bearing device 66.

The stop 92 is positioned between the first rod device 42, the cleaning head 20 and the second rod device 56. In particular, it is positioned between the connecting lines 82*a* and 82*b*.

In relation to the first bearing device 44, the second bearing device 58, the third bearing device 66 and the fourth bearing device 78, the stop 92 is closest to the third bearing device 66.

The housing 70 of the cleaning head 20 and, in particular, an upper side 96 of this housing 70, which faces the overhang region 76, forms a counter-face 98 for the stop face 94 of the stop 92.

The stop 92 is arranged in such a way that in a normal lifting region up to a maximum lifting height H, the stop 92 is ineffective, in other words the stop face 94 does not abut on the counter-face 98. As a result, a parallel orientation of the lower side 84 of the cleaning head 20 with respect to the floor 26 can be achieved.

If a specific lifting height $H_{specific}$ is reached (by pivoting the first rod device 42), the cleaning head 20 abuts on the stop 92. This lifting height $H_{specific}$ is, in particular, in the range between 15 mm and 35 mm and, for example, about 20 mm, if the unlifted position, as shown in FIG. 1, is defined as the zero position.

Figure 6:
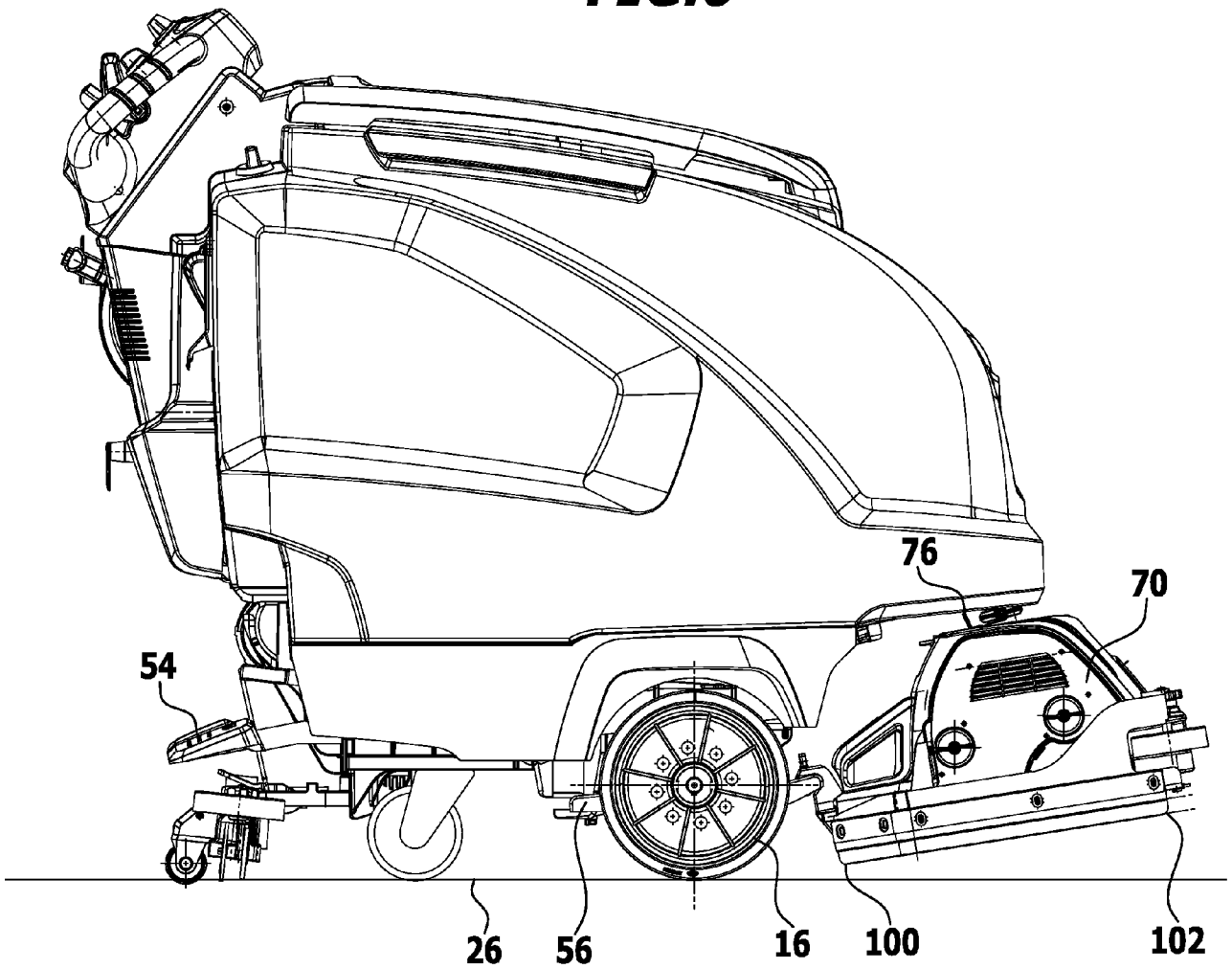
FIG. 6 shows the same view as FIG. 1 with an inclined cleaning head.
Figure 7:
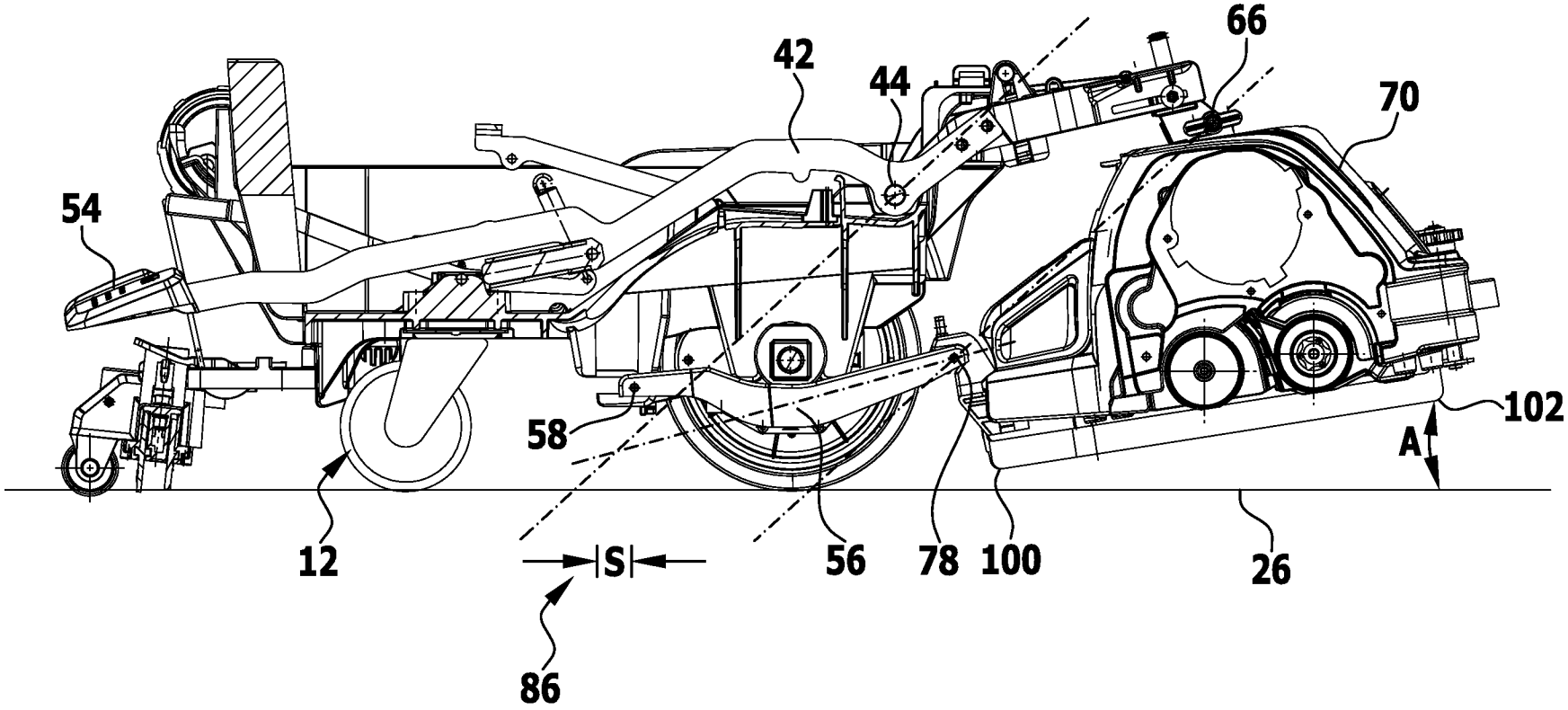
FIG. 7 shows an enlarged sectional view of a part of the floor cleaning machine in the inclined position of the cleaning head according to FIG. 6.
Figure 8:
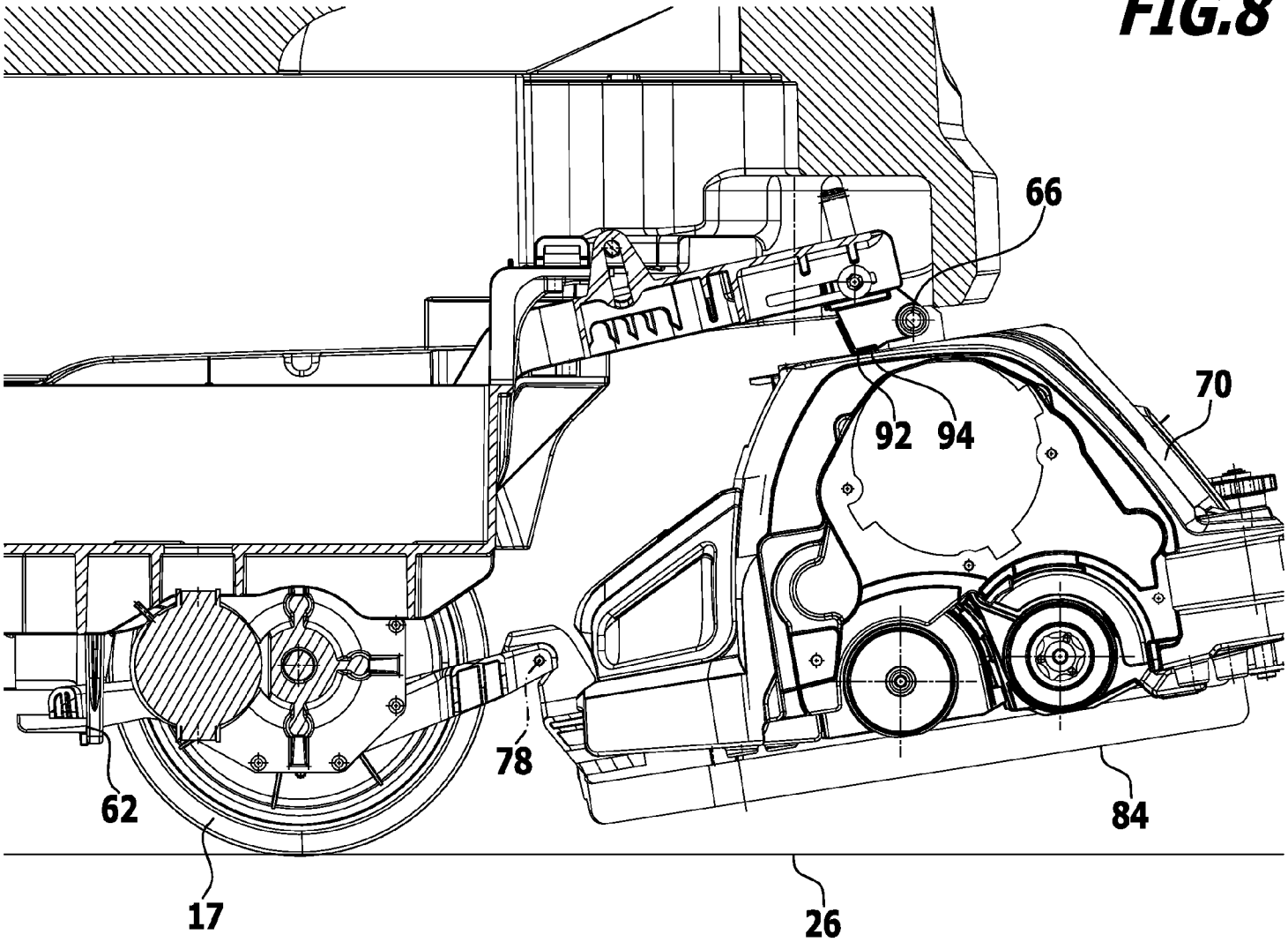
FIG. 8 shows an enlarged view of the cleaning head in the inclined position according to FIG. 6.

When the cleaning head 20 abuts on the stop 92, it is supported on the stop face 94 and a rotary bearing is thereby formed on the stop 92. By pivoting the first rod device 42 further the cleaning head 20, as shown in FIGS. 6 to 8, can then incline toward the chassis 12 and toward the floor 26. This inclination is made possible by the configuration of the second bearing device 48 as a rotary-slide bearing 62, by means of which the second rod device 56 is displaceably held on the chassis 12. In contrast to the case where no support of the cleaning head 20 takes place on the stop 92, the spacing between the rotational axis 46 and the first bearing device 44 and the rotational axis 64 of the second bearing device 58 is then no longer constant.

A displacement path S (cf. FIG. 7) of the rotational axis 64 between the position 86 and a maximum displacement position is, for example, in the range between 15 mm and 40 mm and, for example, in the range between 20 mm and 25 mm.

The maximum lifting position with a lifting height $H_{specific}$ is defined in such a way that a rear end 100 of the cleaning head 20, which is most closely adjacent to the corresponding wheel (such as the right-hand wheel 16), is spaced apart from the floor 26 to such an extent that the inclination movement is possible. During the inclination movement, a rotary bearing ("ad hoc rotary bearing") is formed by the stop face 94 and the counter-face 98 with a pivot axis that is parallel to the rotational axis 46. A front end 102 of the cleaning head 70 is lifted by the inclination of the cleaning head 70 to a greater extent than the rear end 100. A greater spacing A from the floor 26 is then provided in the region of the front end 102 than in the region of the rear end 100.

A position of this type of the cleaning head 70 is advantageous for travelling on a ramp, for example to load the floor cleaning machine 10.

Figure 3:
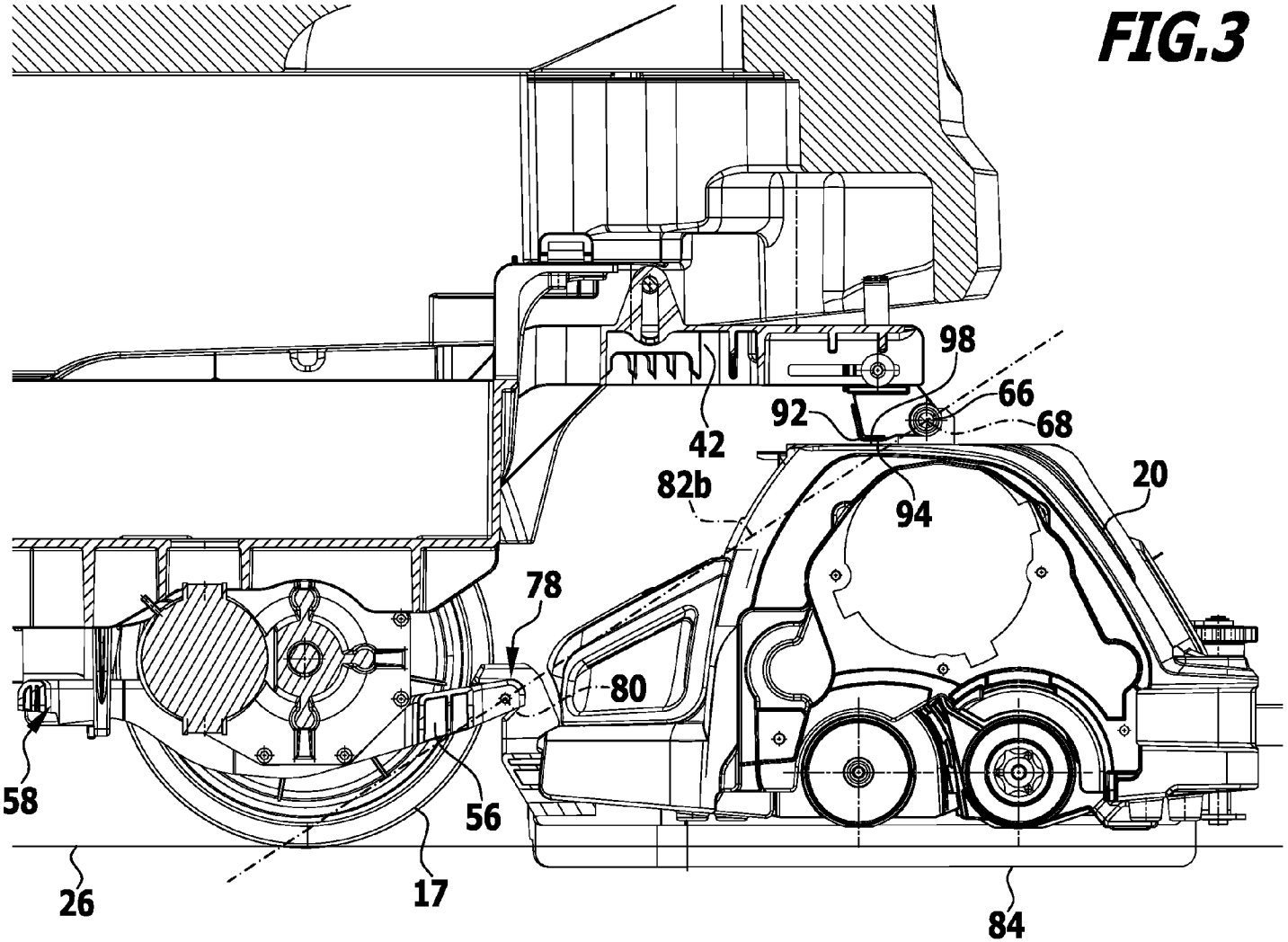
FIG. 3 shows an enlarged view of a front region with a cleaning head in a partial sectional view of the floor cleaning machine according to FIG. 1, the cleaning head not being lifted in relation to a base.

The floor cleaning machine 10 functions as follows (cf. also FIGS. 9 and 10):

In a "normal" cleaning process on a, for example, level floor 26, the cleaning head 20 is in the position as shown in FIGS. 1 to 3.

The cleaning head 20, as shown in FIGS. 4 and 5, can be lifted in order, for example, to compensate irregularities on the floor 26 when cleaning. By setting a special lifting position, wear can also be compensated, for example. (Without wear, a lifting position with a greater spacing H from the floor 26 is provided and with wear, this lifting spacing H is reduced.)

Figure 9:
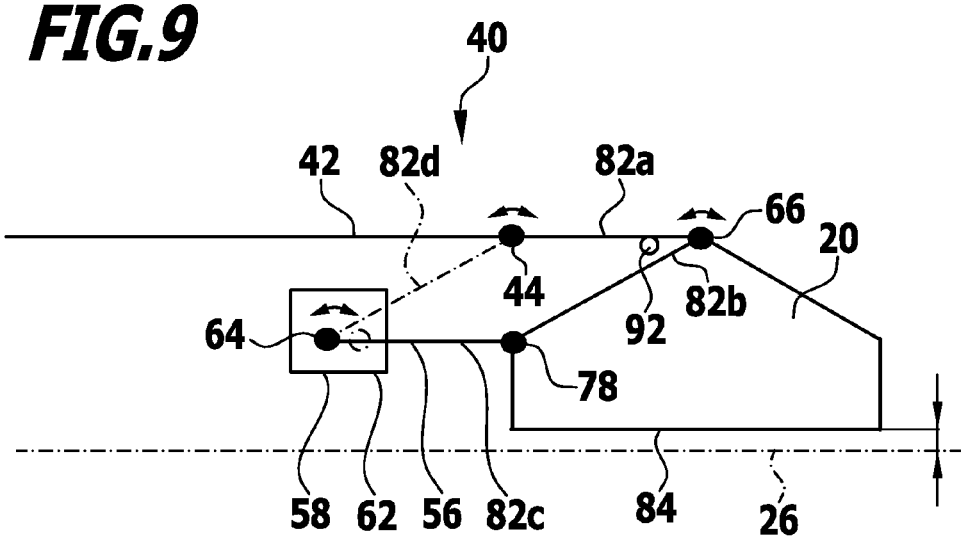
FIG. 9 shows a schematic view of a mechanism for adjusting lifting positions of the cleaning head in a lifting position without an inclination.
Figure 10:
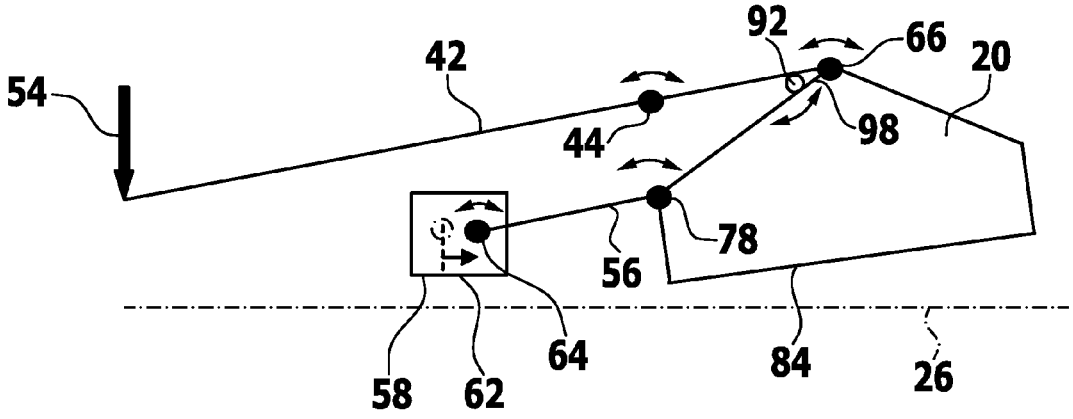
FIG. 10 shows the mechanism according to FIG. 9 with an inclination of the cleaning head.

FIG. 9 schematically shows the position of the elements of the holding device 40 for this. The rotational position or pivoting position of the first rod device 42 (adjusted by means of the pedal 54 and fixed by means of the fixing device 88) determines the lifting position of the cleaning head 20, the lower side 84 being oriented parallel to the floor 26 when the latter is level, when the stop 92 is not yet acting. The connecting lines 82*a*, 82*b*, 82*c*, 82*d* form a parallelogram. When the stop 92 is not acting, a parallelogram 82*a*, 82*b*, 82*c*, 82*d* is present in each lifting position, the corner points of the parallelogram being fixed by the bearing devices 44, 58, 66, 78 and by the corresponding rotational axes.

When the specific lifting position $H_{specific}$ has been reached and the stop 92 acts on the counter-face 98 (cf. FIG. 10), no further parallel lifting is possible because of the stop 92. The position of the rotational axis 64 can be displaced on the rotary-slide bearing 62 in accordance with the prevailing constraints and an inclination of the cleaning head 70 is possible, this inclination being actuated by further pivoting of the first rod device 42.

A type of larger rim width is thereby produced between the floor 26 and the cleaning head 20. This makes it easier for the floor cleaning machine 10 to travel on a ramp, for example to load it.

An inclined position of the cleaning head 20 relative to the chassis 12, for example to travel on a ramp, can be set in a structurally simple manner by the solution according to the invention. The stop face 94 and the counter-face 98, when the stop 92 is acting, form a pivot bearing or rotary bearing, which makes the inclination possible. Owing to the configuration of the second bearing device 58 as a rotary-slide bearing 62, the second rod device 56 is displaceably mounted in such a way that the inclination movement of the cleaning head 20 is made possible.

The solution according to the invention can be used in all types of floor cleaning machines, such as, for example, also ride-on floor cleaning machines.

Owing to the solution according to the invention, with a corresponding configuration of the holding device 40, a synchronous or non-synchronous inclination movement of a plurality of cleaning heads can also be achieved if a plurality of cleaning heads is arranged on the corresponding floor cleaning machine.

LIST OF REFERENCE NUMERALS

10 embodiment
12 chassis
14 wheel device
16 right-hand wheel
17 left-hand wheel
18 support wheel
20 cleaning head
22 brush device
24 surface to be cleaned
26 floor
28 forward travel direction
30 front end
32 rear end
34 guiding device
36 operating device
38 handle unit
40 holding device
42 first rod device
44 first bearing device
46 rotational axis
48 wheel axis
50 front end
52 rear end
54 pedal
56 second rod device
58 second bearing device
59 region
60 holding element
62 rotary-slide bearing
64 rotational axis
66 third bearing device
68 rotational axis
70 housing
72 upper region
74 free region
76 overhang region
78 fourth bearing device
80 rotational axis
82*a, b, c, d* connecting line
84 lower side
86 position
88 fixing device
90 lifting position
92 stop
94 stop face
96 upper side
98 counter-face
100 rear end
102 front end

The invention claimed is:

1. A drivable floor cleaning machine, comprising:

a chassis;

at least one cleaning head; and a holding device, by means of which the at least one cleaning head is held on the chassis and is liftable relative to the chassis, the holding device comprising a first rod device, which is rotatably held by a first bearing device on the chassis, a second rod device, which is rotatably held on the chassis by means of a second bearing device, a third bearing device, by means of which the at least one cleaning head is rotatably held on the first rod device, and a fourth bearing device, by means of which the at least one cleaning head is rotatably held on the second rod device;

wherein a stop is associated with the at least one cleaning head, on which stop the at least one cleaning head is supported when a specific lifting position of the at least one cleaning head relative to the chassis is reached, and on which stop the at least one cleaning head is rotatable by means of the support relative to the chassis.

2. The drivable floor cleaning machine according to claim 1, wherein an angular orientation of a lower side of the at least one cleaning head with respect to the chassis remains the same until the specific lifting position of the at least one cleaning head is reached independently of a rotational position of the first rod device.

3. The drivable floor cleaning machine according to claim 1, wherein at least one of the second rod device and the second bearing device is flexible in such a way that an inclination movement of the at least one cleaning head is made possible upon support on the stop.

4. The drivable floor cleaning machine according to claim 1, wherein the second bearing device comprises a rotary-slide bearing or is configured as a rotary-slide bearing.

5. The drivable floor cleaning machine according to claim 1, wherein a counter-face, which is arranged or formed on a housing of the at least one cleaning head, is associated with the stop.

6. The drivable floor cleaning machine according to claim 1, wherein a stop face of the stop is arranged between the first rod device, the second rod device and the at least one cleaning head.

7. The drivable floor cleaning machine according to claim 6, wherein the stop face in relation to the first bearing device, second bearing device, third bearing device and fourth bearing device is arranged closest to the third bearing device.

8. The drivable floor cleaning machine according to claim 1, wherein upon rotation of the at least one cleaning head by means of support on the stop, a lower side of the at least one cleaning head is at an acute angle with respect to a floor when the floor cleaning machine is placed on a level floor, and wherein a front end of the at least one cleaning head, in relation to a forward travel direction of the floor cleaning machine, has a greater spacing from the floor than a rear end of the at least one cleaning head.

9. The drivable floor cleaning machine according to claim 1, wherein the third bearing device is arranged at or close to a front end, in relation to a forward travel direction of the floor cleaning machine, of the first rod device.

10. The drivable floor cleaning machine according to claim 9, wherein the first bearing device is arranged between the front end and a rear end of the first rod device.

11. The drivable floor cleaning machine according to claim 9, wherein the first rod device comprises a lever arm, which is arranged between a rear end and the first bearing device.

12. The drivable floor cleaning machine according to claim 11, wherein the lever arm forms an actuating device for a rotary movement of the first rod device on the first bearing device or has an operative connection to an actuating device.

13. The drivable floor cleaning machine according to claim 1, wherein the fourth bearing device is arranged at or close to a front end, in relation to a forward travel direction of the floor cleaning machine, of the second rod device.

14. The drivable floor cleaning machine according to claim 13, wherein the second bearing device is arranged at or close to a rear end of the second rod device.

15. The drivable floor cleaning machine according to claim 1, wherein a spacing of rotational axes of the first bearing device and the third bearing device is fixed.

16. The drivable floor cleaning machine according to claim 1, wherein a spacing of rotational axes of the first bearing device and the second bearing device is variable, this spacing remaining fixed.

17. The drivable floor cleaning machine according to claim 1, wherein a position of a rotational axis of the first bearing device relative to the chassis is fixed.

18. The drivable floor cleaning machine according to claim 1, wherein a spacing between rotational axes of the second bearing device and fourth bearing device is fixed.

19. The drivable floor cleaning machine according to claim 18, wherein a maximum displacement path on the second rod device is in a range between 15 mm and 40 mm.

20. The drivable floor cleaning machine according to claim 1, wherein the specific lifting position is provided when the at least one cleaning head is lifted at a spacing in the range between 15 mm and 35 mm over a floor when the floor cleaning machine stands on a level floor.

21. The drivable floor cleaning machine according to claim 1, wherein connecting lines between the rotational axes of the first bearing device and the third bearing device, the third bearing device and the fourth bearing device, the fourth bearing device and the second bearing device and the second bearing device and the first bearing device form a parallelogram when the at least one cleaning head is not supported on the stop.

22. The drivable floor cleaning machine according to claim 1, said drivable floor cleaning machine comprising a fixing device, by means of which one or more rotational positions of the first rod device is fixable.

23. The drivable floor cleaning machine according to claim 1, wherein the second rod device is arranged in a region of a wheel of the floor cleaning machine.

24. The drivable floor cleaning machine according to claim 23, wherein the fourth bearing device, in relation to a forward travel direction of the floor cleaning machine, is arranged in a region in front of the wheel and the second bearing device is arranged in a region behind the wheel.

25. The drivable floor cleaning machine according to claim 1, said drivable floor cleaning machine having a configuration as a self-propelled floor cleaning machine.

26. The drivable floor cleaning machine according to claim 25, said drivable floor cleaning machine having a configuration as a walk-behind machine.

27. The drivable floor cleaning machine according to claim 1, wherein the at least one cleaning head is driven.

* * * * *